United States Patent [19]

Robins

[11] 4,176,616

[45] Dec. 4, 1979

[54] VARIABLE THRUST CONTROLLER FOR WATER JET PROPULSION SYSTEM

[76] Inventor: Thomas L. Robins, 2770 Melendy Dr., #1, San Carlos, Calif. 94070

[21] Appl. No.: 813,933

[22] Filed: Jul. 8, 1977

[51] Int. Cl.[2] ..... B63H 11/02

[52] U.S. Cl. ..... 115/14; 60/221

[58] Field of Search ..... 115/11, 12 R, 12 A, 115/14, 15, 16; 60/221, 228, 230, 232; 239/265.39, 265.37

[56] References Cited

U.S. PATENT DOCUMENTS

| | | | |
|---|---|---|---|
| 3,040,525 | 6/1962 | Cochran | 115/12 R |
| 3,073,277 | 1/1963 | Lee | 60/221 |
| 3,093,966 | 6/1963 | Englehart | 115/14 |
| 3,146,586 | 9/1964 | Newby | 115/14 |
| 3,214,903 | 11/1965 | Cochran | 115/14 |
| 3,244,135 | 4/1966 | Meyerhoff | 115/12 R |
| 3,478,712 | 11/1969 | Fox | 115/12 R |
| 3,946,556 | 3/1976 | Catterfield | 115/16 |
| 3,961,591 | 6/1976 | Fuller | 115/12 R |
| 4,052,007 | 10/1977 | Willard | 239/265.37 |

*Primary Examiner*—Trygve M. Blix
*Assistant Examiner*—D. W. Keen
*Attorney, Agent, or Firm*—Flehr, Hohbach, Test, Albritton & Herbert

[57] ABSTRACT

A water jet propulsion system for moving a boat through the water includes apparatus for varying the thrust of the jet by varying the size of the stream of water being discharged from the nozzle of the jet propulsion unit. The apparatus for constricting the size of the stream of water also serves to direct the thrust of the stream upwardly or downwardly as desired as the stream discharges rearwardly of the boat so as to counteract any tendency of the boat to "porpoise". Interconnected closure members located respectively in the flow path leading directly to the nozzle and in a forwardly directed secondary flow path serve to close off the latter when the water is being passed under pressure via the nozzle and vice versa.

5 Claims, 7 Drawing Figures

VARIABLE THRUST CONTROLLER FOR WATER JET PROPULSION SYSTEM

BACKGROUND OF THE INVENTION

This invention pertains to water jet propulsion systems and more particularly to such a system provided with a variable thrust controller.

Propulsion systems for boats employing a jet of water discharged from the stern of the boat have become increasingly popular. Propulsion systems of the kind described have been arranged to provide a forward thrust to the boat and, by lowering a gate across the end of the discharging nozzle the discharge of water is diverted downwardly and forwardly through a secondary flow passage so as to cause the boat to slow or reverse its direction of travel by applying a reversing thrust.

In a propulsion system of the kind described an impeller provides a flow of water through a discharging nozzle so as to drive the boat forwardly as noted. The impeller in turn is driven by an engine and, in order to adjust the speed of the boat the impeller is driven faster or slower by an engine coupled thereto. Accordingly, at a certain point in time the impeller and motor are operating at full speed and additional speed is not then available. However, there has been a need for the provision of an improved propulsion system in which additional speed can be obtained over and above that obtained from maximum operation of the engine and impeller system.

As disclosed herein means are provided for constricting the opening of the nozzle so as to increase the velocity of the water being discharged from the nozzle and in this way increase the thrust and speed of the boat.

In addition, when racing with boats of the kind described the boats sometimes have had a tendency to bob up and down in a cyclic manner much akin to the movements of a porpoise and therefore referred to as "porpoising" by most boat operators.

As disclosed herein means are provided for overcoming this "porpoising" movement by selectively directing the jet discharge stream upwardly or downwardly to the rear as desired.

In addition to the above, propulsion systems of the kind noted presently can be provided with a downwardly and forwardly open secondary flow passage for applying a reverse thrust to the boat in response to closing of the rearwardly directed nozzle by means of a gate. Thus, as the gate is closed the only escape for water from the impeller is downwardly and forwardly through the secondary flow passage which thereby applies the rearward thrust to the boat. It has been observed that the presence of the continuously open secondary flow passage can serve to reduce the thrust of the rearwardly moving jet stream of water. Accordingly, there has been a need for an improved water jet propulsion system of the kind described having means for adjusting the thrust derived from the stream.

SUMMARY OF THE INVENTION AND OBJECTS

In general there has been provided a water jet propulsion system for moving a boat through the water having an engine and means driven by the engine for discharging a stream of water from the boat at a predetermined volumetric rate so as to generate reaction forces serving to move the boat forwardly in response thereto. The means for generating the stream of water includes a discharge nozzle of predetermined diameter serving to discharge the water therethrough to propel the boat at a predetermined speed associated with the velocity of the discharging water. Means for constricting the size of the stream of the discharging water serves to change the velocity of the stream so as to vary the thrust applied to the boat.

In general, it is an object of the present invention to provide an improved water jet propulsion system.

It is another object of the present invention to provide such a propulsion system in which the size of the stream of water being discharged from the propulsion system can be constricted from a position internally of the boat carrying such system, i.e. by remote control.

Another object of the present invention is to provide an improved reaction drive assembly in which the direction of the discharging stream of water can be varied in order to vary the direction of applied thrust acting on the stern of the boat.

It is another object of the present invention to provide an improved propulsion system in which pressure losses via a secondary flow passage employed for reversing can be minimized.

The foregoing and other objects of the invention shall become more readily evident from the following detailed description of a preferred embodiment when considered in conjunction with the drawings.

DETAILED DESCRIPTION OF PREFERRED EMBODIMENT

Figure 1:
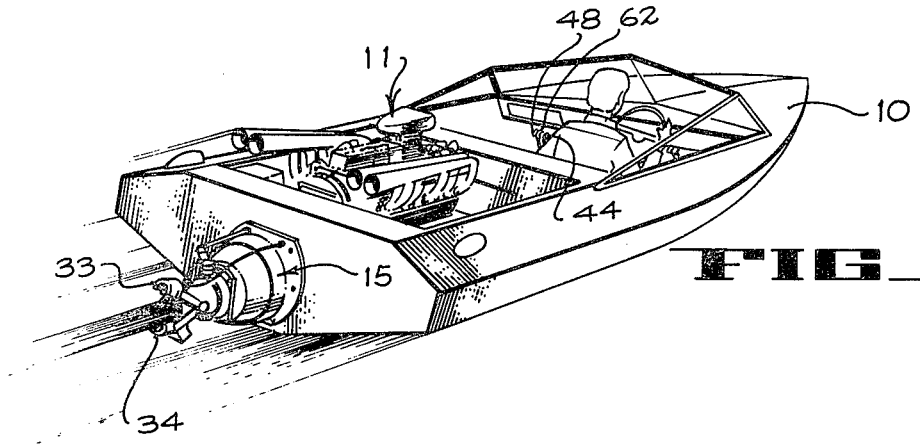
FIG. 1 shows a diagrammatic perspective view of a boat being operated with a propulsion system of the kind described according to the invention.
Figure 2:
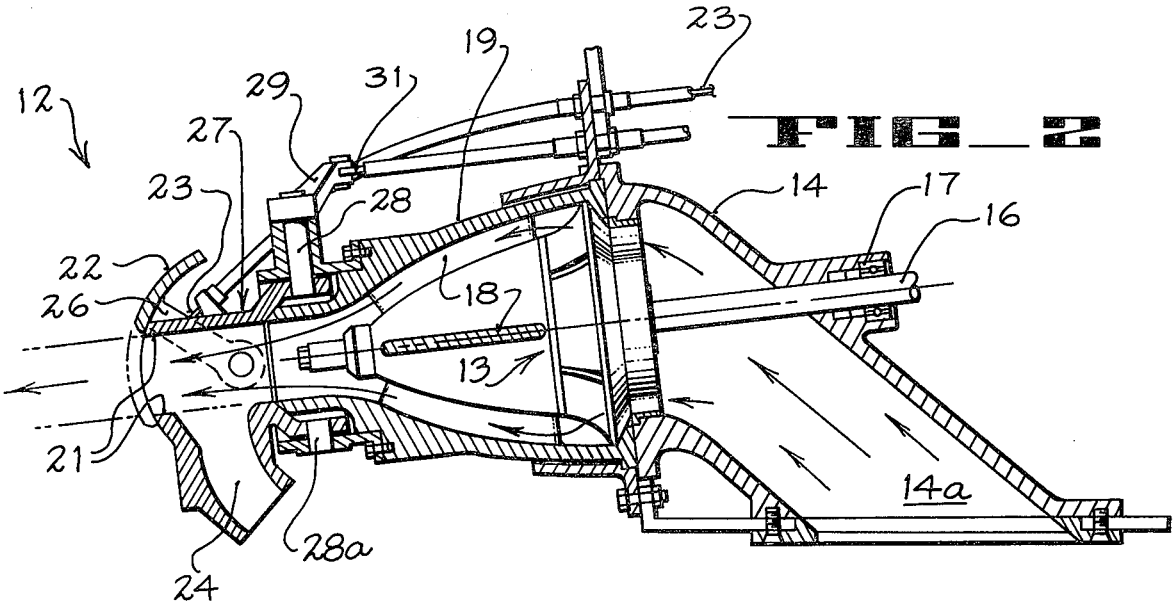
FIG. 2 shows a side elevation section view of a propulsion system for use on a boat of the kind shown in FIG. 1 as provided in the prior art.

As shown in FIG. 1 a boat 10 includes a water jet propulsion system comprising an intended combustion engine 11 for driving a water jet propulsion unit 15 according to the invention As shown in FIG. 2 a water jet propulsion unit 12 according to the prior art comprises an impeller unit 13 mounted for rotation within a housing 14 so as to be driven by means of a drive shaft 16 coupled to engine 11. Shaft 16 is supported at one end by bearings 17 whereby upon rotation of the blades of impeller 13 a flow of water is drawn through the intake end 14*a* of housing 14 to be passed through impeller 13. A plurality of four struts 18 support impeller 13 within housing 19 whereby a flow of water discharges through nozzle 21 of predetermined diameter.

When it is desired to reverse the thrust and cause the boat to slow or to reverse its direction a gate 22 operated by cable 23 can be moved downwardly to close opening 21 and force the flow of water downwardly and forwardly via the secondary flow passage 24.

Gate 22 is supported at each end by means of a lever arm 26 to pivot between raised and lowered positions about a common axis of rotation.

Also, as shown in the prior art represented by FIG. 2 directional control of the boat 10 is accomplished by mounting the trailing nozzle portion 27 to pivot about a vertical axis defined by the pivot pins 28 and 28*a*. A lever arm 29 coupled to pivot pin 28 is moved between advanced and retracted positions by means of a cable 31 so as to cause nozzle opening 21 to be pointed to starboard or port as desired by the operator of the boat.

Figure 3:
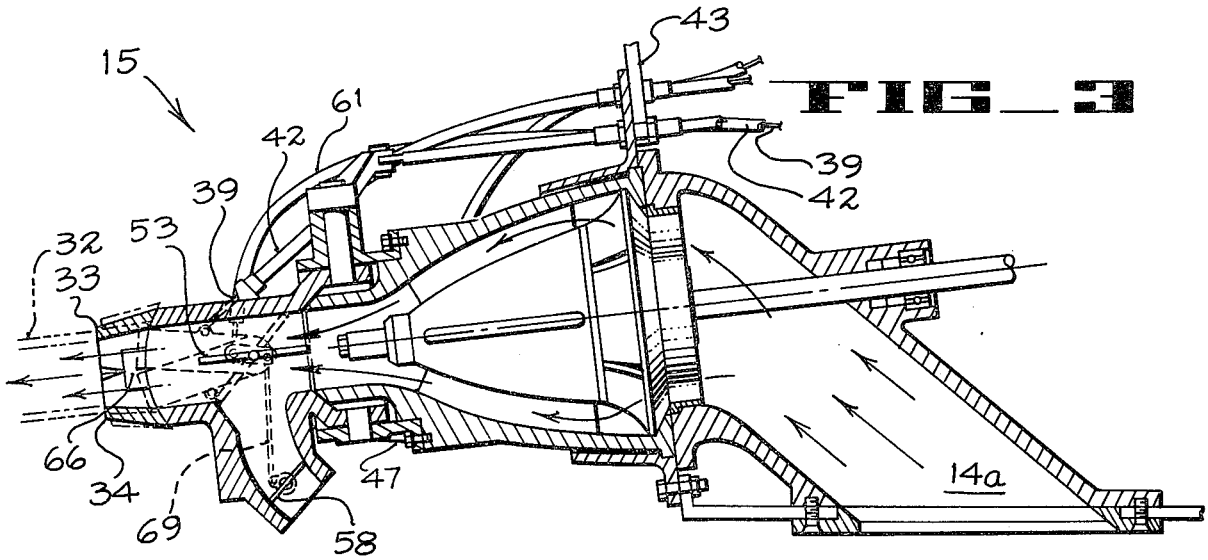
FIG. 3 shows a side elevation section view of a propulsion system for the boat of FIG. 1 according to the invention.
Figure 4:
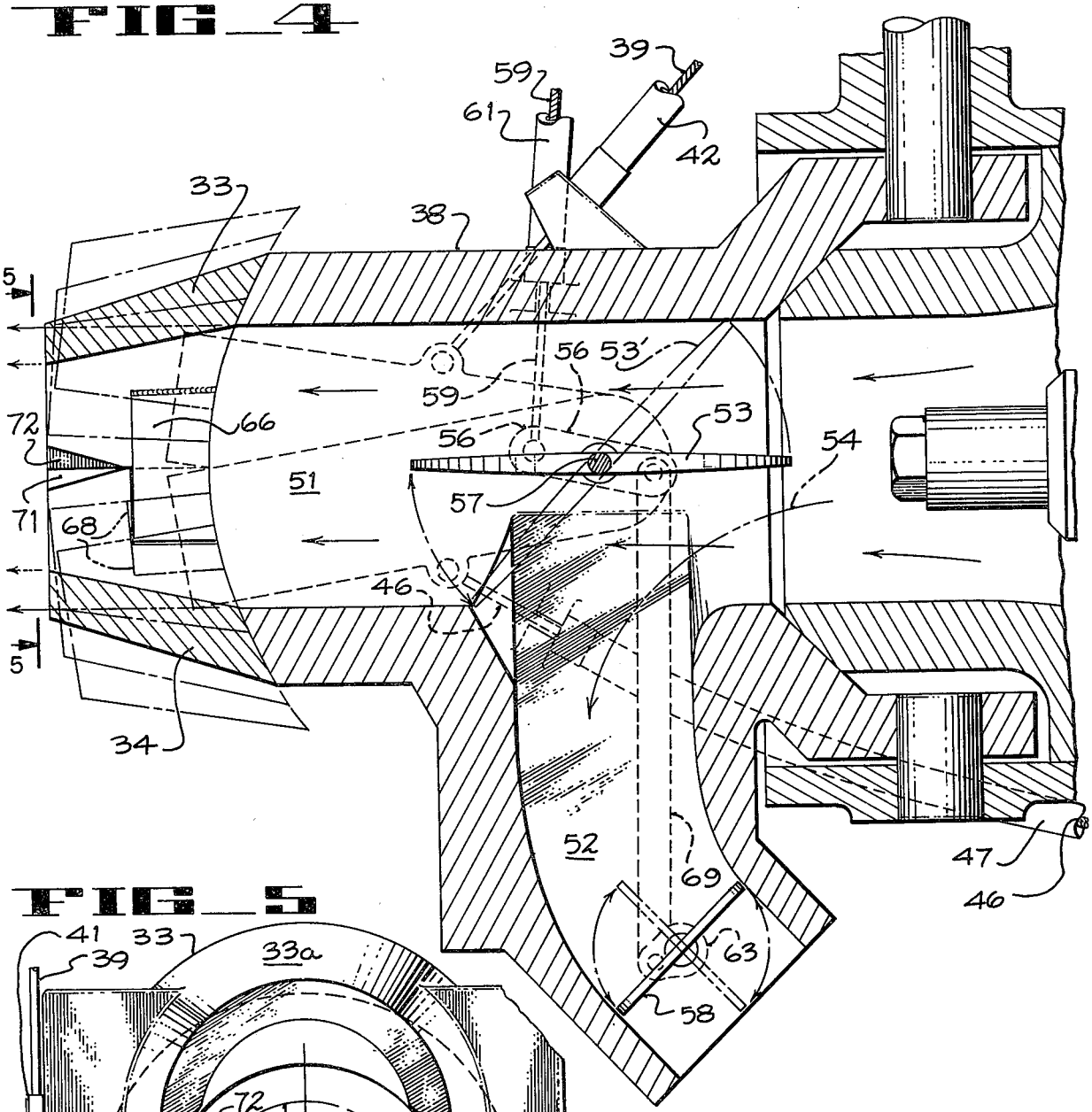
FIG. 4 shows an enlarged detail view of the trailing portions of the propulsion unit shown in FIG. 3.

As shown in FIGS. 3 and 4 an improved propulsion unit 15 has been provided characterized by means for constricting the size of the stream 32 of water being discharged so as to change the velocity of the stream to vary the thrust applied to the boat.

In describing the embodiment shown in FIG. 3 portions corresponding to those previously described relative to the prior art embodiment of FIG. 2 will not necessarily be repeated below in the interest of clarity and for convenience.

Accordingly, a pair of confronting cup-like semi-closures 33, 34 mounted to pivot at the common pivot points 36, 37 are movable into and out of engagement with respect to each other to reduce the size of stream 32. Each semi-closure 33, 34 comprises a semi-cup shaped portion 33*a*, 34*a* carried by a pair of pivot arms 33*b*, 34*b* from pivot points 36, 37 so that as portions 33*a*, 34*a* are moved together a smaller nozzle opening 65 (FIG. 5) is formed.

Upward movement of semi-closure 33 is limited by a fixed stop or abutment (not shown) protruding outwardly of housing 19 for engaging arms 33*b*. Downward movement of semi-closure 34*b* is similarly limited at a predetermined position.

Accordingly, the reduced nozzle opening 65 can be directed to discharge water at any angle defined between the maximum upward position of the lower closure member 34 and the maximum lower position of the upper closure member 33.

As thus arranged the two semi-cup shaped portions 33, 34 serve to define an extension of the nozzle body 38. Pivots 36, 37 carried along the side of the nozzle body 38 support each of the semi-closure members 33, 34 to move independently with respect to each other. Means for operating each of the members 33, 34 to move between advanced and retracted positions independently of the other comprises, with respect to member 33 a cable 39 coupled at one end to the side of member 33 by a conventional fastener 41. Cable 39 is arranged to move in a fixed sheath 42 supported to pass through the transom of boat 10.

At the leading end of cable 39 a controller 44 mounted at a position adjacent to the driver of the boat serves to provide movement of cable 39 between advanced and retracted positions to lift and lower member 33 as desired.

Means for operating member 34 similarly includes a cable 46 disposed in a stationary sheath 47 and operated at its leading end by means of the controller 48.

Figure 7:
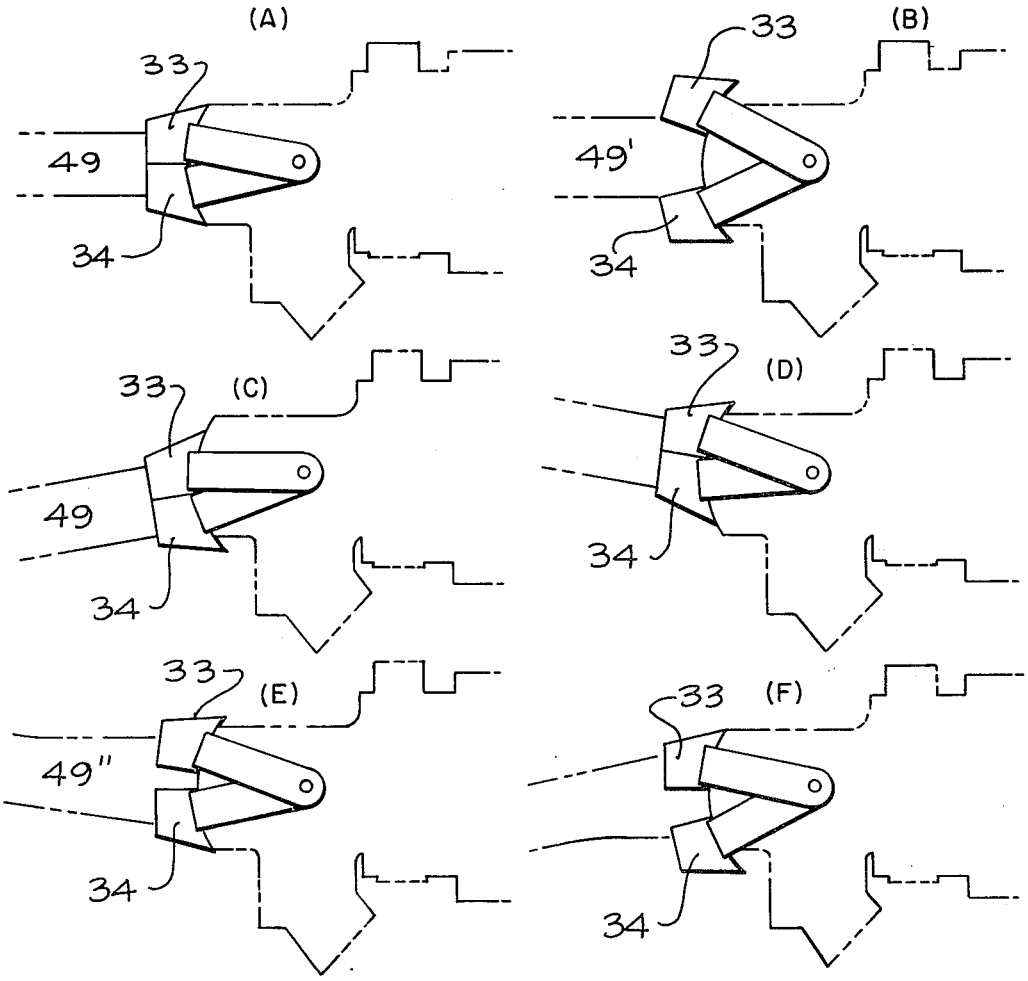
FIG. 7 shows a series of six diagrams lettered A through F representing six different conditions or stages of operation of a propulsion system according to the invention.

As shown in FIG. 7, the independent movement of members 33, 34 relative to each other provides a number of different thrust conditions. As shown in FIG. 7A, members 33, 34 are shown in their fully closed position whereby the output jet 49 or stream of water is reduced to a minimum and discharged directly astern. In this condition and with engine 11 continuing to operate at a predetermined rate providing a predetermined volumeteric flow of water through propulsion unit 15, closing of the discharge opening (as in FIG. 7A) will create a greater velocity to the stream 49 and hence will increase the thrust applied to the boat.

As shown in FIG. 7B, both members 33, 34 have been moved apart to a maximum degree so as to widen the stream 49' thereby providing a slowing for minimum thrust due to minimum velocity of stream 49'.

As shown in FIG. 7C, both members 33, 34 have been moved downwardly to their maximum position providing maximum thrust by constricting the flow path 49 while at the same time providing a certain amount of thrust upwardly to the stern of boat 10. The purpose of disposing members 33, 34 to provide this upward thrust is to overcome "porpoising" movements of the boat as can be encountered, for example, in racing or the like. As shown in FIG. 7D, members 33, 34 have been moved upwardly together to provide maximum constriction (and thrust) of the flow path 49 while at the same time providing a downward thrust to the stern of the boat for overcoming "porpoising" movements in an opposite direction.

As shown in FIG. 7E a partial constriction of the discharge jet 49'' has been provided by maintaining member 33 in its maximum open position while closing member 34 to the position corresponding to the position of member 34 in FIG. 7A. This arrangement provides a limited degree of downward thrust on the stern of boat 10 while at the same time providing a fine adjustment to the constriction being made to the jet of water being discharged.

Similarly, in FIG. 7F member 33 is closed while member 34 remains in its maximum open position. This arrangement provides an opposite thrust to the stern of the boat and at the same time partially limits the degree of constriction of the discharge flow or jet of water.

As thus arranged, it is readily evident that there has been provided means operable from within the boat for selectively directing the stream 49 rearwardly upwardly or rearwardly downwardly from the stern of the boat. The foregoing can be achieved at the same time while constricting the size of the stream of the discharging water so as to change the velocity of the stream to vary the thrust applied to the boat.

Means forming a forwardly directed secondary flow passage 52 in fluid communication with nozzle 51 provides for reversing or slowing the boat.

Closure means, such as the butterfly valve 53, is disposed within nozzle 51 and is movable between a first and a second position. The first position of valve 53 disposes valve 53 parallel to the flow of water passing through nozzle 51. The second position is shown in phantom lines and designated as 53' for selectively directing the discharging stream of water in the direction of arrow 54 so as to be discharged downwardly and forwardly via flow passage 52.

Means for selectively positioning butterfly closure 53 includes a lever arm 56 coupled to the pivot pin 57 which serves to mount valve 53 for movement between closed and open positions. A cable 59 coupled to lever arm 56 is disposed within a stationary sheath 61 and is operated by means of a controller 62 conveniently associated adjacent the driver of the boat.

As thus arranged, movement of cable 59 between advanced and retracted positions serves to selectively position butterfly closure valve 53 in a position directing the discharging stream rearwardly from nozzle 51 to provide forward movement to the boat or, when positioned to the phantom line position 53′ serving to direct the discharging stream forwardly via flow passage 52 to apply a reversing thrust to boat 10.

With valve 53 disposed for passing water rearwardly from nozzle 51 it has been observed that some loss of pressure applied to the rearwardly moving water is occasioned by the presence of the open secondary flow passage 52. Accordingly, a second closure means in the form of the butterfly valve 58 has been pivotally mounted in flow passage 52. Means coupling butterfly valve 53 to butterfly valve 58 serves to dispose valve 58 in a fluid blocking relation while valve 53 is disposed in a fluid transmitting relation for passing fluid via nozzle 51 and vice versa.

In short, when valve 53 has been positioned to pass the water rearwardly out of nozzle 51 it is desirable to close secondary flow passage 52 by means of butterfly valve 58. This is accomplished by a connecting link 69 connected at its upper end to the free end of lever arm 56 and connected at its lower end to a bell crank 63.

Finally, it will be readily evident that as members 33, 34 are moved apart a gap will be formed between at the sides thereof permitting the jet of discharging water to escape therethrough causing loss in thrust. Accordingly, means forming side barriers serve to inhibit the escape of water laterally between the open members 53, 54 and comprises a pair of rearwardly extending panels 64, 66 welded to depend downwardly from member 33 to pass into notches 68.

Figure 5:
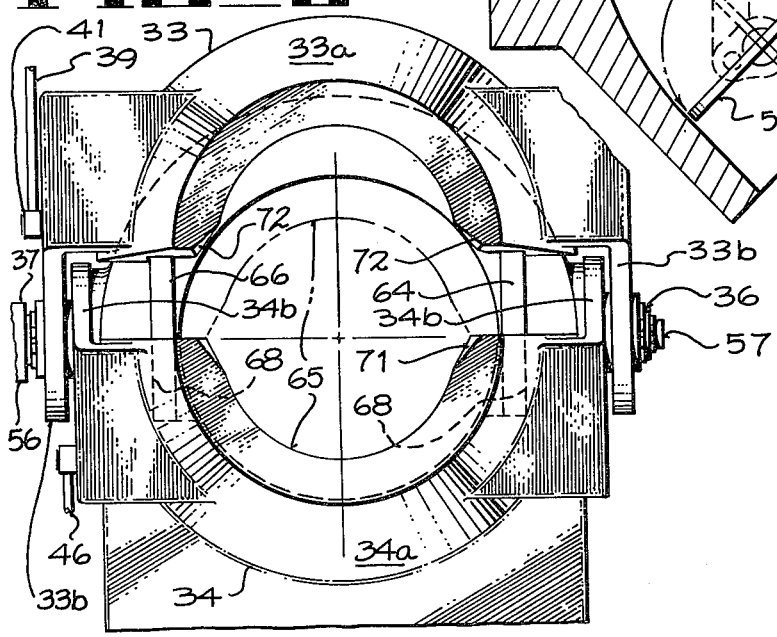
FIG. 5 shows in enlarged detail an end view of the propulsion unit shown in FIG. 4.
Figure 6:
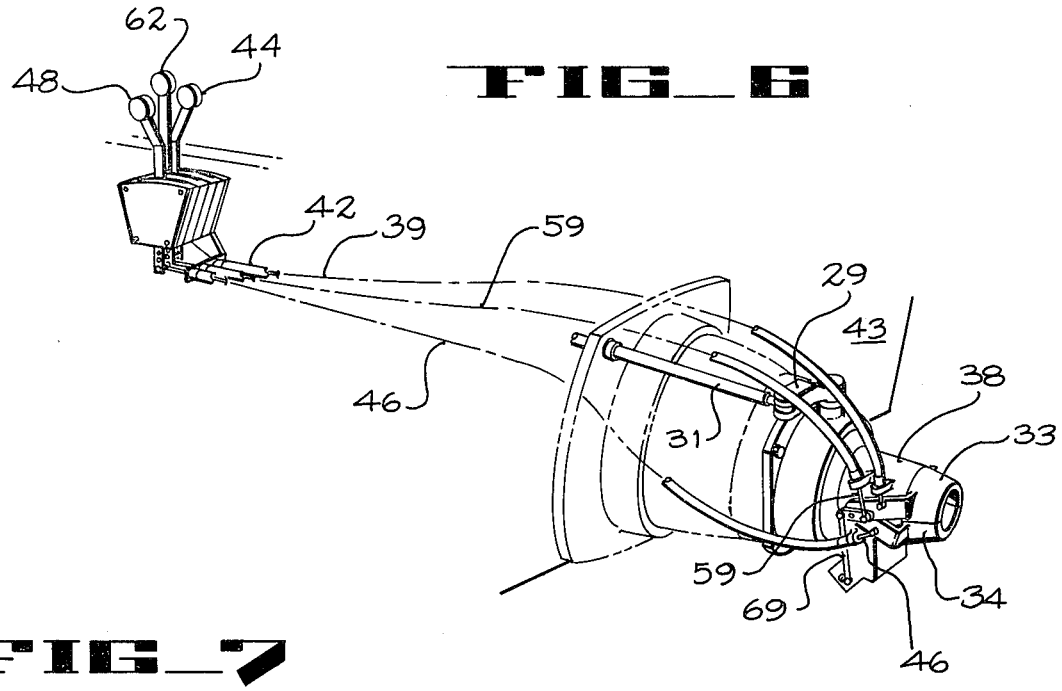
FIG. 6 shows a diagrammatic perspective view of a propulsion unit according to the invention.

As shown best in FIGS. 5 and 4 the corners 71, 72 have been chamfered in order to remove them from invading the jet stream discharging from unit 15 when members 33, 34 have been moved fully apart so as to prevent interference with the flow of the stream of water.

I claim:

1. In a water jet propulsion system of a type for moving a boat through the water and having an engine and means driven by said engine for discharging a stream of water from the boat to generate thrust serving to move the boat in response thereto, the last named means comprising a discharge nozzle of predetermined diameter serving to discharge the water therethrough to propel said boat at a speed associated with thrust derived from the velocity of said discharging liquid, means for constricting the size of said stream of said discharging water to change the velocity of said stream to vary the thrust applied to the boat, means forming forwardly directed flow passage in fluid communication with said nozzle, first closure means within said nozzle movable between first and second positions for selectively directing the discharging stream rearwardly of said nozzle to provide forward movement to said boat or forwardly via said flow passage to apply a reversing thrust to the boat, a second closure means, said second closure means being disposed in said flow passage, and means coupling said first closure means to said second closure means for disposing said second closure means in fluid blocking relation when disposing the first closure means in fluid transmitting relation rearwardly via said nozzle and vice versa.

2. In a water jet propulsion system for moving a boat through the water and having an engine and means driven by said engine for discharging a stream of water from the boat to generate thrust serving to move the boat in response thereto, the last named means including a discharge nozzle of predetermined diameter directed rearwardly of the boat and serving to discharge the water therethrough to propel said boat at a predetermined speed associated with the velocity of said discharging water, means forming a forwardly directed flow passage in fluid communication with said nozzle, first closure means for selectively directing the discharging stream forwardly via said flow passage to apply a reversing thrust to the boat, second closure means, said second closure means being disposed in said flow passage, and means operably coupling the first closure means with the second closure means for disposing the second closure means in fluid blocking relation in said flow passage when disposing the first closure means in fluid passing relation via said nozzle and vice versa.

3. In a water jet propulsion system of a type for moving a boat through the water and having an engine and means driven by said engine for discharging a stream of water from the boat to generate thrust serving to move the boat in response thereto, the last named means comprising a discharge nozzle of predetermined diameter serving to discharge the water therethrough to propel said boat at a speed associated with thrust derived from the velocity of said discharging liquid, and means for constricting the size of said stream of said discharging water to change the velocity of said stream to vary the thrust applied to the boat, said means for constricting the size of said stream of discharging water comprising first and second semi-annular closure portions selectively and independently movable between upper and lower positions into and out of said stream for variably constricting the size of the stream from one or the other or both sides thereof.

4. In a water jet propulsion system for moving a boat through the water and having an engine and means driven by the engine for supplying water to be discharged in a stream from the boat to apply a thrust to the boat in a direction substantially opposite to the direction of the discharging stream, the last named means including a discharge nozzle of varying size, and means operable from a position accessible to the driver of the boat while underway for selectively changing the size of said nozzle to vary the thrust derived from same for the same volumetric rate of flow of water being discharged via said nozzle, said last named means serving to selectively direct the discharging water upwardly or downwardly to control vertical movement of the stern of the boat.

5. In a water jet propulsion system of a type for moving a boat through the water and having an engine and means driven by said engine for discharging a stream of water from the boat to generate thrust serving to move the boat in response thereto, the last named means comprising a nozzle assembly including an annular discharge nozzle of predetermined diameter serving to discharge water therethrough to propel said boat at a speed associated with thrust derived from the velocity of said discharging liquid, means pivotally supporting said assembly for directing the discharge of water selectively to either side of the path of movement of the boat for steering the boat, means pivotally movable between spaced and closed positions for varying the opening through said nozzle and for directing the discharging water upwardly and downwardly to control vertical movement of the stern of the boat, means forming a forwardly directed flow passage in fluid communication with said nozzle, and closure means disposed within said nozzle movable between first and second positions for selectively directing the discharging stream rearwardly of said nozzle to provide forward movement to said boat or forwardly via said flow passage to apply a reversing thrust to the boat.

* * * * *